United States Patent [19]

Turner

[11] 4,201,403

[45] May 6, 1980

[54] INDEX TAB DEVICE AND INDEX TAB THEREFOR

[76] Inventor: James F. Turner, 27639 Forestbrook Dr., Farmington Hills, Mich. 48018

[21] Appl. No.: 846,724

[22] Filed: Oct. 31, 1977

[51] Int. Cl.[2] ..... G09F 3/10

[52] U.S. Cl. ..... 283/21; 283/36

[58] Field of Search ..... 283/1 R, 21, 36

[56] References Cited

U.S. PATENT DOCUMENTS

| | | | |
|---|---|---|---|
| 1,868,188 | 7/1932 | Barker | 283/21 X |
| 2,213,666 | 9/1940 | Burke | 283/21 |
| 2,975,091 | 3/1961 | Tobey | 283/21 X |
| 3,226,862 | 1/1966 | Gabruk | 283/21 |
| 3,473,827 | 10/1969 | Leadbetter | 283/36 |
| 3,854,229 | 12/1974 | Morgan | 283/21 X |
| 3,938,268 | 2/1976 | Gilhula | 283/36 X |

*Primary Examiner*—Willie G. Abercrombie
*Attorney, Agent, or Firm*—Remy J. VanOphem

[57] ABSTRACT

A planar index tab suitable for marking particular pages of a book or the like has one of its surfaces only locally coated with a pressure sensitive adhesive. The portion of the index tab coated with the adhesive is placed in adhesive contact with the page to be marked so that the portion of the index tab not coated with the adhesive projects beyond the margin of the page. Further, an index tab device for storing and dispensing index tabs having a backing sheet which has at least one surface with a low adhesive affinity to the pressure sensitive adhesive locally coating the index tabs. A plurality of index tabs are disposed in spaced apart array on the surface of the backing sheet having low adhesive affinity with the surface of the tabs locally coated with the adhesive in adhesive contact therewith.

10 Claims, 10 Drawing Figures

INDEX TAB DEVICE AND INDEX TAB THEREFOR

BACKGROUND OF THE INVENTION

The present invention relates to special labels or stickers and more particularly to an index tab and an index tab device for storing and dispensing the index tabs.

In ordinary business routine, large many-paged files are usually gathered containing needed information. Certain pages of a file may be more frequently referred to than other pages, or may be of more importance than other pages. It is desirable to conspicuously mark these pages so that they can be quickly referred to with a minimum of searching.

It is known to use markers attached to particular pages of a book or file to highlight or mark them for ready reference.

Various types of index tabs or markers are shown in U.S. Pat. No. 1,326,370 issued on Dec. 30, 1919; U.S. Pat. No. 2,170,147 issued on Aug. 22, 1939 to J. D. Lane; U.S. Pat. No. 2,797,801 issued on July 2, 1957 to J. H. Bishop; U.S. Pat. No. 3,314,529 issued on Apr. 18, 1967 to R. P. Glorviak and U.S. Pat. No. 3,347,361 issued on Oct. 17, 1967 to C. B. Lindeke.

BRIEF SUMMARY OF THE INVENTION

An object of the present invention is to provide an index tab which is easy to apply to a page to be marked.

It is another object of the present invention to provide an index tab which is conspicuous when attached to a page.

It is a further object of the present invention to provide an index tab which is easily removable from a backing sheet prior to being applied to a page to be marked.

It is still a further object of the present invention to provide an index tab which is relatively inexpensive to manufacture and, therefore, sell.

More particularly, the present invention provides an index tab consisting of a thin planar tab forming body having one planar surface only locally coated with a pressure sensitive adhesive, thus, leaving a portion of this planar surface free of adhesive. The opposite planar surface of the tab forming body is entirely free of adhesive.

The present invention also contemplates an index tab device for storing and dispensing the above described index tab backer sheet having at least one surface with a low adhesive affinity to the pressure sensitive adhesive locally coating one surface of the index tab forming bodies. A plurality of the tab forming bodies are disposed in spaced apart array on at least the surface of the backer sheet having a low affinity to the adhesive with the one surface of each tab forming body which is locally coated with adhesive in contact therewith.

DESCRIPTION OF THE DRAWING

A better understanding of the invention will be had upon reference to the following specification and accompanying drawing wherein like numerals refer to like parts throughout the figures, and wherein.

DETAILED DESCRIPTION OF THE PREFERRED EMBODIMENT

Figure 1:
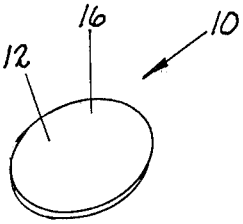
FIG. 1 is a perspective view of one advantageous embodiment of an index tab of the present invention.
Figure 2:
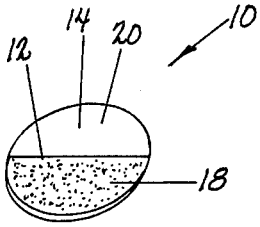
FIG. 2 is a perspective view of the embodiment of FIG. 1, but showing the opposite surface thereof.
Figure 3:
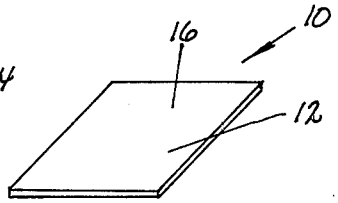
FIG. 3 is a perspective view of another advantageous embodiment of the index tab of the present invention.
Figure 4:
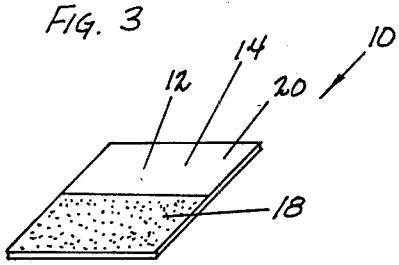
FIG. 4 is a perspective view of the embodiment of FIG. 3, but showing the opposite surface thereof.

FIGS. 1–4 show an index tab, generally denoted as the numeral 10, which consists of a thin planar tab forming body 12 having two planar surfaces 14 and 16. One planar surface, for example planar surface 14, is only locally coated in a single zone, as denoted by the numeral 18, with a pressure sensitive adhesive. Because the planar surface 14 is only locally coated as at zone 18, a portion 20 of the surface 14 remains free of adhesive. The opposite planar surface 16 of the tab forming body 12 is completely free of adhesive. The index tab forming body 12 is preferably geometrical in shape. For example, the tab forming body 12 illustrated in FIGS. 1 and 2 is circular while the tab forming body 12 illustrated in FIGS. 3 and 4 is rectangular. Preferably, the area of the zone 18 of the planar surface 14 which is locally coated with the pressure sensitive adhesive is no more than 50% of the total area of the surface 14. The zone 18 coated with adhesive does not extend across the centerline of the surface 14. Thus, when the tab forming body 12 has a geometrically shaped periphery, the zone 18 coated with pressure sensitive adhesive is symmetric about the centerline of the surface 14 with the portion 20 which is free of adhesive.

Various types of suitable pressure sensitive adhesives are well known in the art and, therefore, will not be discussed further.

Figure 5:
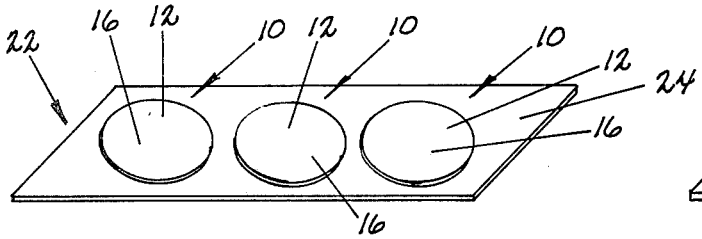
FIG. 5 is a perspective view of one advantageous embodiment of an index tab device for storing and dispensing the index tabs of FIGS. 1 and 2.
Figure 6:
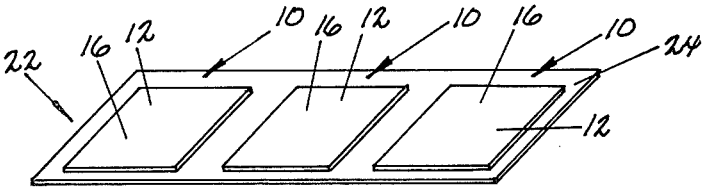
FIG. 6 is a perspective view of another advantageous embodiment of an index tab device for storing and dispensing the index tabs of FIGS. 3 and 4.

Now turning to FIGS. 5 and 6, an index tab device for storing and dispensing the index tabs 10 is generally denoted as the numeral 22. The index tab device 22 consists of a flexible index tab backer sheet 24 illustrated in strip form. The backer sheet 22 has at least one surface, for example surface 24, which has a low adhesive affinity to the pressure sensitive adhesive coating 18 of the tab forming body 12. For example, the backer sheet could be fabricated of kraft paper, or of a wax coated paper. A plurality of index tabs 10 are disposed in spaced apart array over the surface 24 of low adhesive affinity such that the planar surface 14 with the pressure sensitive adhesive coat 18 of each index tab 10 is in contact with the surface 24. Thus, the index tabs 10 are maintained in position on the backer sheet 22. In order to remove an index tab 10 from the backer sheet 22, it is merely necessary to grasp the tab at the portion 20 which is free of adhesive and lift the tab from the backer sheet 22. Because the surface 24 of the backer sheet 22 has a low adhesive affinity for the pressure sensitive coating 18 of the index tabs 10, the tabs 10 are easily detached from the backer sheet without destroying the adhesive property of the coating 18.

Figure 7:
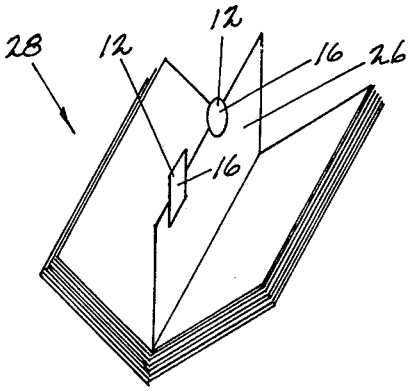
FIG. 7 illustrates the index tabs of FIGS. 1 and 2, and FIGS. 3 and 4 affixed to a page or leaf of a file.

FIG. 7 illustrates an index tab 10 of FIGS. 1 and 2, as well as an index tab 10 of FIGS. 3 and 4 adhesively attached to a page or leaf 26 of a file or book 28. While two tabs 10 are shown attached to the page 26 to illustrate the attachment of both the circular and rectangular tabs it should be realized that only one such tab need be used. The index tab 10 is oriented relative to the page 26 to be marked with the zone 18 of pressure sensitive adhesive coating in contact with the page 26 and the portion 20 of the index tab free of adhesive projecting from the margin of the page 26. Any notation which may be desired to identify the contents of the page 26 marked by the tab 10 may be written on the surface 16 or portion 20 of the tab 10.

Figure 9:
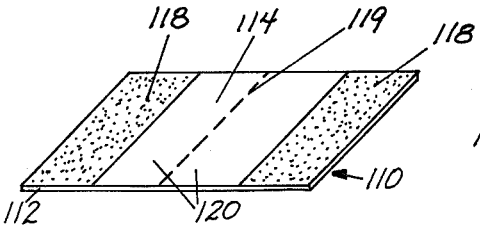
FIG. 9 is a perspective view of the embodiment of FIG. 8, but showing the opposite surface thereof; and, FIG. 10 illustrates the index tab of FIGS. 8 and 9 affixed to a page or leaf of a file.
Figure 8:
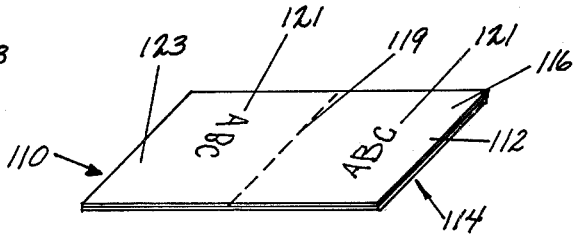
FIG. 8 is a perspective view of yet another advantageous embodiment of an index tab of the present invention.

FIGS. 8 and 9 illustrate another advantageous embodiment of an index tab, generally denoted as the numeral 110, which consists of a thin planar tab forming body 112 having two planar surfaces 114 and 116. The tab forming body 112 is illustrated as being generally rectangular. One planar surface, for example planar surface 114, is only locally coated, in two different spaced apart zones, as denoted by the numerals 118, with a pressure sensitive adhesive. The area of each of the two coated zones 118 covers no more than 25% of the total area of the surface 114 and they are disposed at opposite ends of the tab forming body 112 so that the sum total of the coated zones 118 is no more than 50% of the total area of the surface 114. Thus, a portion 120 is left between the coated areas which is free of adhesive. In addition, a score line 119 is formed in the tab forming body 112 generally transverse to the longitudinal axis of the tab forming body 112 and generally equally spaced between the two adhesive coated zones 118 so that they are symmetric about the score line 119.

It is sometimes desirable that the index tab 10, 110 be preprinted with certain predetermined indicia on its surface 16, 116 as indicated in FIG. 8 by numeral 121. This indicia 121 may take any form such as, for example, letters of the alphabet or product names.

It is also contemplated that in the event that the surface 16, 116 has a preprinted indicia thereon that the surface 16, 116 be covered with a plastic laminate, as indicated by the numeral 123 in FIG. 8, to prevent smudging of the indicia 121.

Figure 10:
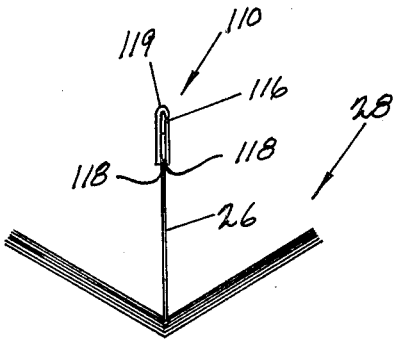

FIG. 10 illustrates the rectangular index tab 110 of FIGS. 8 and 9 adhesively attached to a page 26 of the file or book 28. To affix the index tab 110 to the page 26, the index tab 110 is folded along the score line 119 so that the two adhesively coated zones 118 are in facing relationship. The index tab 110 is disposed so that one of the coated zones 118 is in adhesive contact with one side of the page 26 and the other one of the coated zones 118 is in adhesive contact with the opposite side of the same page 26, and so that the portion 120 of the tab projects from the margin of the page 26.

It should be clearly understood that the index tab 110 can be attached to the backer sheet 22 for storage and dispensing in the same manner as index tabs 10. That is, each index tab 110 is disposed over the surface 24 of low adhesive affinity such that the planar surface 114 with the pressure sensitive adhesive zones 118 is in contact with the surface 24.

The foregoing detailed description is given primarily for clarity of understanding and no unnecessary limitations should be understood therefrom for modification will be obvious to those skilled in the art upon reading this disclosure and may be made without departing from the spirit of the invention or the scope of the appended claims.

What is claimed is:

1. An index tab device for storing and dispensing at least one index tab comprising:

a thin planar tab forming body having a first planar surface coated portion with a pressure sensitive adhesive on no more than one-half of said first surface thereby leaving a remainder of said first surface uncoated such that when said first planar surface is mounted contiguous to a backer sheet only said coated portion adheres to said backer sheet while said uncoated portion allows unrestrained removal of said tab from said backer sheet without affecting the adhesive property of said coated portion by grasping said tab by said uncoated surface area;

an opposite planar surface suitable for printing conspicuous indexing information, whereby when said tab is removed from said backer sheet and applied along the edge of a multiple-part indexable item in a manner such that said no more than one half of said first surface coated with pressure sensitive adhesive is applied directly to a part of said multiple-part indexable item, said uncoated remainder of said first surface protruding from said multiple-part indexable item beyond the edge thereof, thereby exposing said opposite planar surface and appropriate indexing information printed thereon despite said multiple-part indexable item being closed or complied so as to conceal said no more than one-half of said first planar surface, thereby facilitating location of a part of said multiple-part indexable item according to correlation between said indexing information and the part attached thereto; and a flexible index tab backer sheet having at least one surface with a low adhesive affinity to said pressure sensitive adhesive and having said first planar surface of said at least one index tab applied thereto for dispensing said at least one tab wherein said at least one index tab is disposed on said at least one surface of said backer sheet having said low adhesive affinity with said no more than one-half of said first planar surface of each of said at least one tab forming body in contact with said one surface of said backer sheet having said low adhesive affinity, thus, maintaining said at least one index tab in position on said backer sheet while allowing any of said at least one index tab to be selectively and easily detached from said backer sheet without affecting the adhesive property of said at least one index tab.

2. An index tab for use in indexing a multple-part indexable item comprising:

a thin planar tab forming body having a first planar surface coated portion with a pressure sensitive adhesive on no more than one-half of said first surface thereby leaving a remainder of said first surface uncoated such that when said first planar surface is mounted contiguous to a backer sheet only said coated portion adheres to said backer sheet while said uncoated portion allows unrestrained removal of said tab from said backer sheet without affecting the adhesive property of said coated portion by grasping said tab by said uncoated surface area; and an opposite planar surface suitable for printing conspicuous indexing information, whereby when said tab is removed from said backer sheet and applied along the edge of a multiple-part indexable item in a manner such that said no more than one half of said first surface coated with pressure sensitive adhesive is applied directly to a part of said multiple part indexable item, said uncoated remainder of said first surface protruding from said multiple-part indexable item beyond the edge thereof, thereby exposing said opposite planar surface and appropriate indexing information printed thereon despite said multiple-part indexable item being closed or complied so as to conceal said no more than one-half of said first planar surface, thereby facilitating location of a part of said multiple-part indexable item according to correlation between said indexing information and the part attached thereto.

3. The index tab of claim 2, wherein said tab forming body has a geometrically shaped periphery.

4. The index tab of claim 3, wherein said no more than one half of said first surface coated by said pressure sensitive adhesive is a single zone.

5. The index tab of claim 4, wherein said single zone does not extend across a centerline of said tab forming body.

6. The index tab of claim 4, wherein said single zone is symmetric about a centerline of said tab forming body with said uncoated remainder.

7. The index tab of claim 3, wherein said no more than one-half of said first surface comprises two separate spaced apart zones of adhesive with said uncoated remainder being disposed entirely between said two zones.

8. The index tab of claim 7, further comprising a score line formed in said tab forming body across said uncoated remainder and equally spaced between said two zones wherein said two zones are symmetric.

9. The index tab of claim 2, wherein said opposite planar surface of said tab forming body has disposed thereon predetermined indicia.

10. The index tab of claim 3, wherein said opposite planar surface of said tab forming body is covered with a plastic laminate.

* * * * *